United States Patent [19]

Sautebin

[11] Patent Number: 4,473,106

[45] Date of Patent: Sep. 25, 1984

[54] PROCESS FOR COOLING A CONTINUOUSLY CAST STRAND OF METAL DURING CASTING

[75] Inventor: Raoul Sautebin, Sierre, Switzerland

[73] Assignee: Swiss Aluminium Ltd., Chippis, Switzerland

[21] Appl. No.: 436,569

[22] Filed: Oct. 25, 1982

[30] Foreign Application Priority Data

Nov. 20, 1981 [CH] Switzerland ..... 7449/81

[51] Int. Cl.[3] ..... B22D 11/124

[52] U.S. Cl. ..... 164/486; 164/128

[58] Field of Search ..... 164/444, 472, 485–487, 164/128

[56] References Cited

U.S. PATENT DOCUMENTS 3,397,734 8/1968 Brown ..... 164/472

4,166,495 9/1979 Yu ..... 164/486

*Primary Examiner*—Kuang Y. Lin

*Assistant Examiner*—Richard K. Seidel

*Attorney, Agent, or Firm*—Bachman and LaPointe

[57] ABSTRACT

A continuously cast strand or ingot of metal is cooled as it emerges from the mold by applying a coolant directly to the surface of the strand. In order to prevent distortion at the foot of the ingot due to too abrupt cooling, polymers of molecular weight $10^4$–$10^8$ are added to the coolant at least during the initial phase of casting. By the addition of polymers to the coolant the kinetics of formation and discharge of vapor bubbles as the coolant strikes the ingot surface are significantly altered due to the reduction in the surface tension of the coolant; as a result of this an insulating film of coolant vapor forms on the surface of the ingot thus reducing the heat flow from the ingot.

11 Claims, No Drawings

PROCESS FOR COOLING A CONTINUOUSLY CAST STRAND OF METAL DURING CASTING

BACKGROUND OF THE INVENTION

The invention relates to a process for cooling a strand of metal as it emerges from the mold during continuous casting by applying a coolant directly to the surface of the strand.

Continuous casting with direct cooling is such that the surface of the metal strand emerging from the mold is jetted with coolant immediately below the mold in order to extract heat from the metal. During the so-called start-up phase of the ingot casting, or drop as it is often called, the coolant impinges at first only on the dummy base. The resultant indirect cooling at this stage leads to a moderate solidification of the liquid metal and to a flat walled foot of the ingot. As the dummy base sinks progressively, the coolant strikes the ingot surface directly, which produces a sudden increase in heat extraction from the metal strand. The thermal stresses created as a result of this thermal shock are greater than the yield strength of the ingot, and produce a permanent deformation in the form of a convex curve in the foot of the ingot, and on exceeding the tensile strength of the material leads to cracks in the ingot. In order to produce a continuously cast ingot with a planar base or foot, the strand may not therefore be cooled too strongly during start-up.

A process is known whereby, at least during the start-up phase, the coolant is fed in pulses in order to reduce the cooling intensity.

Also known is a process in which, at least during the start-up, the coolant contains gas introduced under pressure. As the coolant strikes the surface of the ingot, the gas dissolved in the coolant forms an insulating film which reduces heat extraction and therefore the cooling effect.

SUMMARY OF THE INVENTION

In view of the above it is an object of the present invention to develop a process of the kind mentioned above by means of which the cooling intensity can be reduced, simply and without the above mentioned disadvantages.

This object is achieved by way of the invention in which, at least during the start-up phase of casting, polymers of a molecular weight of $10^4$ to $10^8$ are added to the coolant.

By making this polymer addition to the coolant the kinetics of formation and release of vapor bubbles as the coolant strikes the hot ingot surface are drastically altered as a result of the marked reduction in surface tension of the coolant, and to such an extent that an insulating film of coolant vapor forms on the ingot surface and hinders heat removal from the ingot.

DETAILED DESCRIPTION

The polymers can be fed in a concentrated form, for example as a solution of 10–50 g polymers/liter of coolant, from a storage tank into a coolant supply pipe by means of a controlled feed pump.

It has been found that, if water is employed as the coolant, dissolved non-ionic polyethylene oxides of a molecular weight of $10^5$ to $5\times10^6$ are particularly suitable polymers for this purpose.

In a further advantageous version of the invention using water as coolant polymers of partially hydrolized anionic poly-acryl-amides with a molecular weight of $10^6$ to $5\times10^7$ are employed as additive. Preferred poly-acryl-amides in this case exhibit a 10–20% degree of hydrolysis and a molecular weight of about $1.5\times10^7$.

The process according to the invention can be realized both with conventional and electromagnetic molds for continuous casting, and is particularly suitable for casting light metals, especially aluminum and aluminum alloys. The concentration of additive in the coolant medium is chosen according to the desired degree of reduction in cooling intensity, and is normally of the order of 1–100 mg/liter.

After the start-up phase has ended, the addition of the polymers to the coolant can be stopped. In another version of the process according to the invention the concentration of polymers in the coolant is continuously lowered during the start-up phase. In certain cases, however, it can be useful to employ the process according to the invention throughout the whole of the casting period.

Further advantages, features and details of the invention are revealed in the following description of preferred exemplified embodiments.

An aluminum alloy 3004 was cast in the form of ingots 500 mm×1600 mm in cross section under normal casting conditions in a vertical DC casting unit fitted with electromagnetic molds. The coolant feed rate was kept constant at 600 liters/minute during the whole of the time of casting. The polymers listed in the table below were added to the cooling water until a 100 mm length of ingot has been cast. To this end a solution containing 10–50 g polymers per liter of water was pumped under control from a storage tank directly into the main cooling water supply pipe. The concentrations of the polymers produced in the cooling water are also listed in the same table. No polymer addition was made to the cooling water during the rest of the drop.

TABLE

Concentration of Polymers in Storage Tank and in Cooling water

| Polymers | Concentration in storage tank g/liter | Concentration in cooling water mg/liter |
|---|---|---|
| Poly-ethylene-oxide Mw $4\times10^6$ | 10 | 30–70 |
| Poly-acryl-amide MW $1.5\times10^7$ anion., 15% hydrol. | 30 | 5–25 |

By maintaining the listed concentrations of additives in the cooling water during the start-up phase an almost curvature-free and crack-free ingot was obtained as a result of the reduction in cooling intensity.

What is claimed is:

1. A process which comprises: casting an ingot from a mold; providing a coolant having added thereto polymeric material with a molecular weight of $10^4$ to $10^8$; and applying said coolant-polymeric material mixture to the surface of the ingot as it emerges from the mold, thereby reducing the surface tension of the coolant, forming an insulating film of coolant vapor on the surface of the ingot and reducing the heat flow from the ingot, whereby distortion due to abrupt cooling is prevented.

2. A process according to claim 1 including the steps of providing a coolant supply means and feeding said polymeric material into said coolant supply means.

3. A process according to claim 1 wherein said ingot is aluminum or an aluminum alloy.

4. A process according to claim 1 wherein the concentration of polymeric material in said coolant is lowered during the start-up phase of said casting.

5. A process according to claim 1 wherein said polymeric material is added to the coolant at least during the start of the start-up phrase of the casting.

6. A process according to claim 1 wherein said ingot is continuously cast.

7. A process according to claim 1 wherein water is employed as coolant and non-ionic polyethylene oxides with a molecular weight of $10^5$ to $5\times10^6$ are employed as polymers and as such in the dissolved form.

8. A process according to claim 1 wherein water is employed as coolant ad partially hydrolyzed anionic poly-acryl-amides with a molecular weight of $10^6$ to $5\times10^7$ are employed as polymers.

9. A process according to claim 8 wherein poly-acrylamides with a 10–20% degree of hydrolysis and molecular weight of approximately $1.5\times10^7$ are employed.

10. A process according to claim 1 wherein the polymers are added to the coolant to produce a concentration of 1–100 mg/liter thereof.

11. A process according to claim 1 wherein the polymers are fed to the coolant in the desired quantities in the form of a concentrated solution containing 10–50 g/liter of said polymers.

* * * * *

UNITED STATES PATENT AND TRADEMARK OFFICE

CERTIFICATE OF CORRECTION

PATENT NO. : 4,473,106

DATED : September 25, 1984

INVENTOR(S) : Raoul Sautebin

It is certified that error appears in the above–identified patent and that said Letters Patent are hereby corrected as shown below:

Column 2, line 32, change "has" to read ---had---.

Column 3, line 8, claim 5, change "phrase" to read ---phase---.

Column 4, line 2, claim 8, change "ad" to read ---and---.

Signed and Sealed this

*Twelfth* Day of *March 1985*

[SEAL]

*Attest:*

DONALD J. QUIGG

*Attesting Officer* *Acting Commissioner of Patents and Trademarks*